US008125353B2

(12) United States Patent
Weisser et al.

(10) Patent No.: US 8,125,353 B2
(45) Date of Patent: Feb. 28, 2012

(54) VEHICLE ARRIVAL ALERTING METHOD AND SYSTEM THEREOF

(76) Inventors: Kimberly Weisser, Modesto, CA (US); Steven Weisser, Modesto, CA (US)

( * ) Notice: Subject to any disclaimer, the term of this patent is extended or adjusted under 35 U.S.C. 154(b) by 344 days.

(21) Appl. No.: 12/392,254

(22) Filed: Feb. 25, 2009

(65) Prior Publication Data

US 2010/0214134 A1 Aug. 26, 2010

(51) Int. Cl.
*G08G 1/123* (2006.01)

(52) U.S. Cl. ..... 340/994; 340/988

(58) Field of Classification Search ..... 340/994, 340/988; 701/117, 300
See application file for complete search history.

(56) References Cited

U.S. PATENT DOCUMENTS

| | | | | | |
|---|---|---|---|---|---|
| 4,297,672 | A | * | 10/1981 | Fruchey et al. | 340/994 |
| 4,325,057 | A | * | 4/1982 | Bishop | 340/994 |
| 4,350,969 | A | * | 9/1982 | Greer | 340/994 |
| 5,623,260 | A | | 4/1997 | Jones et al. | |
| 5,657,007 | A | * | 8/1997 | Anderson et al. | 340/994 |
| 6,097,317 | A | * | 8/2000 | Lewiner et al. | 340/994 |
| 7,202,801 | B2 | * | 4/2007 | Chou | 340/994 |
| 7,479,900 | B2 | * | 1/2009 | Horstemeyer | 340/994 |
| 2005/0131625 | A1 | | 6/2005 | Birger et al. | |

* cited by examiner

*Primary Examiner* — John A Tweel, Jr.
(74) *Attorney, Agent, or Firm* — Jerry D. Haynes; The Law Office of Jerry D. Haynes

(57) ABSTRACT

Disclosed are a method and a system for alerting a user of a vehicle's arrival at a user location. A wireless signal is transmitted to the user location from a transmitter station located on the vehicle. The wireless signal is transmitted when the vehicle is within a predefined distance range of the user location. Further, the wireless signal is received at a base station located at the user location. Moreover, a sensory alert signal is generated at the base station based on the received wireless signal for alerting the user of the vehicle's arrival at the user location.

14 Claims, 5 Drawing Sheets

VEHICLE ARRIVAL ALERTING METHOD AND SYSTEM THEREOF

FIELD OF THE INVENTION

The present invention relates generally to an alerting system, and, more particularly, to a method and system for alerting a user of arrival of a vehicle at a user location.

BACKGROUND OF THE INVENTION

Typically, people use public transport for traveling to their desired locations. The public transport is usually utilized by passengers for reaching various locations. Examples of the public transport include a school bus, an employee pick-up bus, and other similar modes of public transport. The public transport may also be referred to as a vehicle. Normally, the public transport follows a predefined route and halts at the various locations that lie along the route. The various locations are passenger pick-up locations and passenger drop-off locations to pick and drop passengers availing the public transport.

Generally, the passengers availing the public transport are notified by way of a predetermined written schedule, for example, of designated times at which the public transport is expected to arrive at their pick-up locations. Accordingly, a passenger may prepare in advance to reach a pick-up location from his home at a designated time. Sometimes, the passenger may reach the pick-up location earlier than the designated time. In some cases, the passenger may reach the pick-up location on time, but, the public transport may reach later than the designated time. This may happen due to a variety of reasons, such as break-down of the public transport, traffic congestion on the route, and the like. To avoid unnecessary waiting, the passenger may prefer to reach the pick-up location at substantially the same time as, or just after, the arrival of the public transport. In some cases, the passenger may also get delayed in reaching the pick-up location due to certain circumstances. In such cases, a driver or a conductor of the public transport may sound a horn to alert the passenger that the public transport has arrived at the pick-up location.

In another method known in the art, a calculation is done to estimate time that the public transport will take to reach the pick-up location and the estimated time is dynamically updated as the public transport approaches the pick-up location. Accordingly, the passenger is informed of the estimated time. In yet another technique known in the art, the passenger and the public transport may communicate through a common network. The passenger may get information related to current location of the public transport and the estimated time to reach the pick-up location.

However, the methods as described above suffer from a few drawbacks. In some methods, the passenger may need to wait for a long duration for the public transport to arrive. However, waiting for the public transport to arrive may pose a risk for the passenger. The risk may exist due to harsh weather conditions, heavy traffic at the pick-up location, secluded pick-up location, and the like. In other commonly followed practices, the passenger prefers to arrive after the vehicle has arrived at the pick-up location. However, in such a case, the driver or the conductor of the public transport resorts to sounding the horn to alert the passenger of the arrival of the public transport. This may cause discomfort to people who may reside in a neighborhood of the pick-up location. Further, peace and tranquility of the neighborhood may be disturbed by noise of the horn. In addition, passengers who are seated in the public transport need to wait for the passenger to arrive at the pick-up location and board the public transport.

Furthermore, other methods involving communication between the passengers and the public transport require a substantial amount of investment in infrastructure for the techniques to work properly, thereby increasing cost of the techniques. Moreover, the techniques may be complicated to use.

In light of the drawbacks mentioned above, there is a need for alerting a passenger of arrival of a public transport at a pick-up location. Further, there exists a need to reduce a time spent by a passenger waiting at a pick-up location for a public transport to arrive. Moreover, there is a need to reduce a time spent by passengers seated in a public transport waiting for a passenger to board the public transport at a pick-up location. Furthermore, there exists a need for alerting a user of arrival of a public transport in a cost-effective and user friendly manner.

SUMMARY OF THE INVENTION

In view of the foregoing disadvantages inherent in the prior art, the general purpose of the present invention is to provide a method and system for alerting a user of arrival of a vehicle, configured to include all the advantages of the prior art, and to overcome the drawbacks inherent therein.

Accordingly, an object of the present invention is to alert a user of arrival of a vehicle at a user location.

Another object of the present invention is to reduce time spent by a user in waiting for a vehicle to arrive.

Yet another object of the present invention is to reduce time spent by passengers present in a vehicle, waiting for a user to arrive at a pick-up point to board the vehicle.

Still another object of the present invention is to alert a user of a vehicle's arrival at a user location in a cost-effective manner.

Yet another object of the present invention is to alert a user of a vehicle's arrival at a user location in a user-friendly manner.

In light of the above objects, in one aspect of the present invention, a method for alerting a user of a vehicle's arrival at a user location is provided. A wireless signal is transmitted to a base station located at the user location from a transmitter station located on the vehicle. The wireless signal is transmitted when the vehicle is at least within a predefined distance range of the user location. Thereafter, the wireless signal is received at the base station located at the user location. Further, a sensory alert signal is generated at the base station based on the received wireless signal. The sensory alert signal alerts the user of the vehicle's arrival.

In another aspect of the present invention, a method for alerting a user of a vehicle's arrival at a user location is provided. A wireless signal is received at a base station located at the user location. The wireless signal is transmitted to the user from a transmitter station located on the vehicle. Thereafter, a sensory alert signal is generated based on the received wireless signal.

In another aspect of the present invention, a system for alerting a user of a vehicle's arrival at a user location. The system includes a transmitter station and a base station. The transmitter station is located on the vehicle and is configured to transmit a wireless signal to the user. The wireless signal is transmitted when the vehicle is at least within a predefined distance range of the user location. The base station is located at the user location. The base station includes a receiving unit and a sensory alert unit. The receiving unit is configured to receive the wireless signal. The sensory alert unit is configured to generate a sensory alert signal based on the received wireless signal.

These together with other aspects of the present invention, along with the various features of novelty that characterize the present invention, are pointed out with particularity in the claims annexed hereto and form a part of this present invention. For a better understanding of the present invention, its operating advantages, and the specific objects attained by its uses, reference should be made to the accompanying drawing and descriptive matter in which there are illustrated exemplary embodiments of the present invention.

BRIEF DESCRIPTION OF THE DRAWINGS

The advantages and features of the present invention will become better understood with reference to the following detailed description and claims taken in conjunction with the accompanying drawings, in which:

Like reference numerals refer to like parts throughout the description of several views of the drawings.

DETAILED DESCRIPTION OF THE INVENTION

The exemplary embodiments described herein detail for illustrative purposes are subject to many variations in composition, structure, and design. It should be emphasized, however, that the present invention is not limited to particular method and system for alerting a user of a vehicle's arrival at a user location, as shown and described. It is understood that various omissions and substitutions of equivalents are contemplated as circumstances may suggest or render expedient, but these are intended to cover the application or implementation without departing from the spirit or scope of the claims of the present invention. Also, it is to be understood that the phraseology and terminology used herein is for the purpose of description and should not be regarded as limiting.

The terms "a" and "an" herein do not denote a limitation of quantity, but rather denote the presence of at least one of the referenced items.

The present invention provides a method and a system for alerting a passenger (hereinafter referred to as 'user') of arrival of a vehicle at a user location. The method and system find their application in various situations for example a school bus arrival notification, a public transport bus arrival notification, a ferry boat arrival notification, and the like.

A system for alerting a user of a vehicle's arrival includes a transmitter station and a base station. The transmitter station has been explained in conjunction with FIG. 1.

Figure 1:
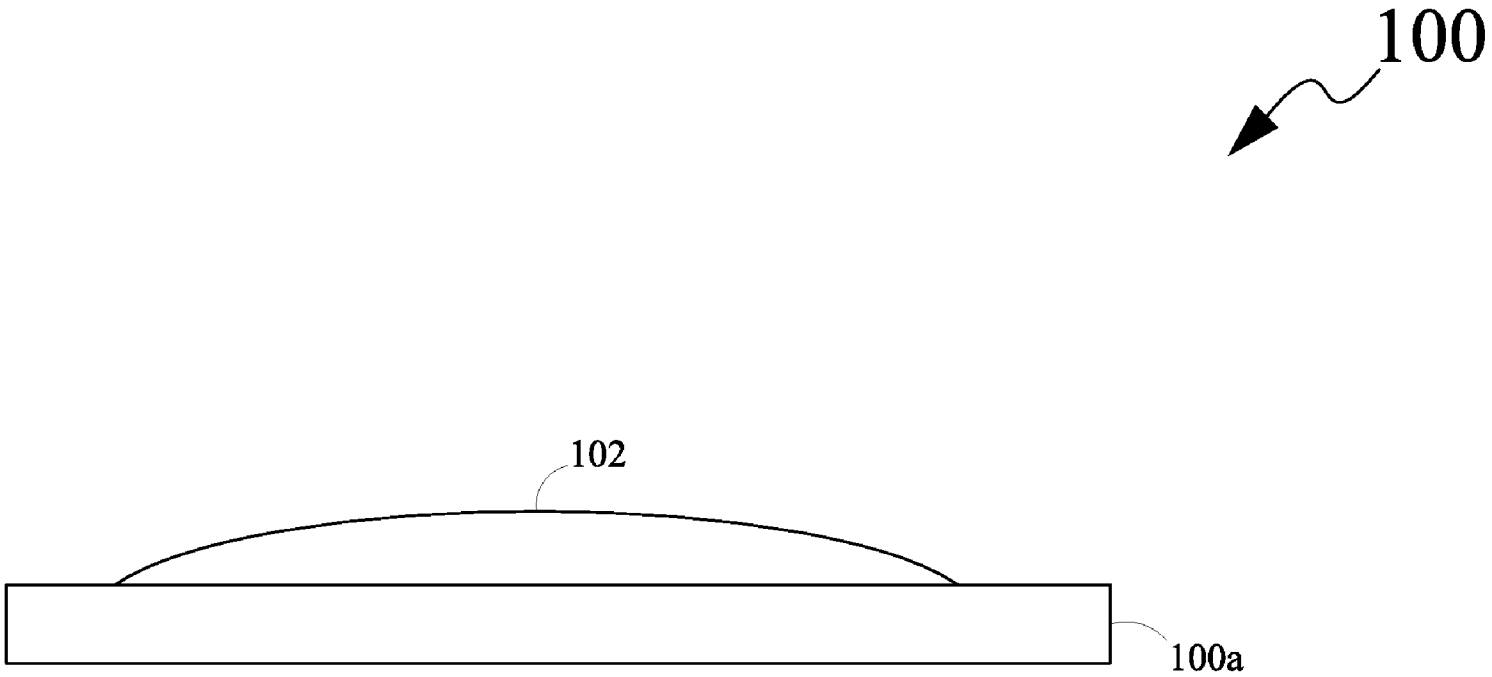
FIG. 1 illustrates a side view of a transmitter station located on a vehicle, in accordance with an embodiment of the present invention.

Referring to FIG. 1, a transmitter station 100 is shown. The transmitter station 100 may be located on a vehicle. Examples of the vehicle include a school bus, a pooled car, a ferry boat, a train, a tram, and the like. The transmitter station 100 includes a transmitter unit 100*a*. The transmitter station 100, located on the vehicle, is configured to transmit a wireless signal to a user at a user location. More specifically, the transmitter unit 100*a* of the transmitter station 100 is configured to transmit the wireless signal to the user, at the user location, when the vehicle is at least within a predefined distance range of the user location. Examples of the user location include residence of the user, waiting room of a train station, waiting room of a bus depot, and the like. Further, examples of the wireless signal may include a Radio Frequency signal (RF), a microwave signal, an infra-red signal, a Bluetooth signal, a Wireless Fidelity (Wi-Fi) signal, and the like. It will be obvious to a person skilled in the art that the user location may be a pick-up point at which the vehicle is scheduled to arrive to pick the user. Alternatively, the pick-up point may be in a vicinity of the user location. However, for the purpose of this description, the user location is considered to be the pick-up point.

In an embodiment of the present invention, the transmitter station 100 includes a transmitter button 102, as shown in FIG. 1. The transmitter button 102 is configured to receive an input for transmitting the wireless signal to the user at the user location. The input may be provided by a person, such as a driver or a conductor of the vehicle, by pressing the transmitter button 102. The input may be provided for transmitting the wireless signal to the user location when the vehicle is at least within the predefined distance range of the user location. Examples of the transmitter button 102 may include a toggle switch, a pushbutton switch, a selector switch, a joystick switch, and the like.

In an embodiment of the present invention, the wireless signal transmitted to the user at the user location may include information, such as, distance of the vehicle from the user location, estimated time to reach the user location, and the like.

The information may be embedded within the wireless signal based on the input received from the person responsible for transmitting the wireless signal in the vehicle. For the same purpose, in another embodiment of the present invention, the transmitter station 100 may include an interface module (not shown) for providing an interface to the person responsible for transmitting the wireless signal from the vehicle.

In another embodiment of the present invention, the transmitter station 100 may include a transmitter antenna (not shown). The transmitter antenna may be configured to assist in transmission of the wireless signal to the user.

It will be apparent to a person skilled in the art that the transmitter unit 100*a* may include signal transmission circuitry for transmitting wireless signals. Further, components of the transmitter station 100, such as the transmitter unit 100*a*, the transmitter button 102 and the interface module may be implemented as hardware modules, software modules, firmware modules, or any combination thereof. The base station of the system for alerting the user of the vehicle's arrival is explained in conjunction with FIGS. 2 and 3.

Figure 2:
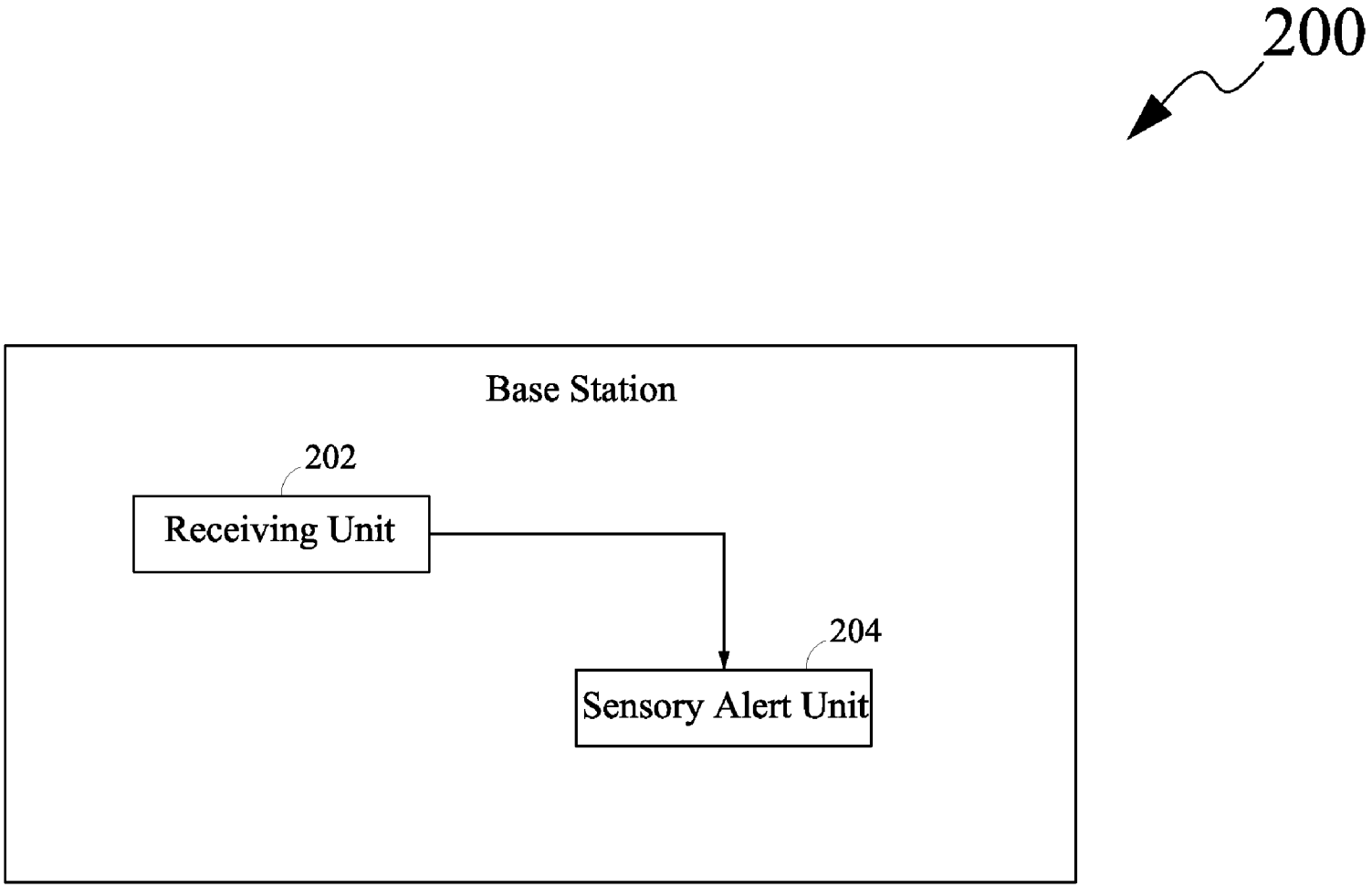
FIG. 2 illustrates a block diagram of a base station located at a user location, in accordance with an embodiment of the present invention.

Referring now to FIG. 2, there is shown a block diagram of a base station 200. The base station 200 is located at a user location for alerting a user at the user location of a vehicle's arrival at the user location. As explained in FIG. 1, it will be apparent to a person skilled in the art that the user location may be a pick-up point at which the vehicle is scheduled to arrive to pick the user. Alternatively, the pick-up point may be in a vicinity of the user location. However, for the purpose of this description, the user location is considered to be the pick-up point.

The base station 200, located at the user location, includes a receiving unit 202 and a sensory alert unit 204. The receiving unit 202 is configured to receive the wireless signal transmitted by the transmitter station 100. Reception of the wireless signal at the user location indicates an impending arrival of the vehicle at the user location.

Further, the sensory alert unit 204 is configured to generate a sensory alert signal based on the received wireless signal. The sensory alert signal includes at least one of a visual alert signal, an audio alert signal and a vibration alert signal. More specifically, the sensory alert unit 204 includes at least one of a light source (not shown) for generating the visual alert signal, a speaker (not shown) for generating the audio alert signal and a motor (not shown) for generating the vibration alert signal.

In an embodiment of the present invention, the light source may be configured to generate a flashing light to alert the user. In another embodiment of the present invention, the speaker may be configured to generate a sound, such as a bell or sound of a horn, to alert the user. In yet another embodiment of the present invention, the motor may be configured to generate a vibration to alert the user. It will be obvious to a person skilled in the art that the user may be alerted by a combination of the visual alert signal, the audio alert signal and the vibration alert signal.

In an embodiment of the present invention, the base station 200 may include a decoder (not shown) configured to decode information embedded in the wireless signal. Examples of the information may include distance of the vehicle from the user location, estimated time to reach the user location, and the like. Further, the base station 200 may include a display unit (not shown) configured to display the decoded information. In another embodiment of the present invention, the speaker may provide the decoded information to the user in an audio format.

It will be apparent to a person skilled in the art that the receiving unit 202 may include signal reception circuitry for receiving the wireless signal transmitted by the transmitter station 100. Further, the sensory alert unit 204 may include circuitry to decode the information transmitted by the transmitter station 100. Furthermore, the sensory alert unit 204 may include circuitry to modify and/or amplify the decoded signals. Moreover, components of the base station 200, such as the receiving unit 202, the sensory alert unit 204, the light source, the speaker, the motor, the decoder and the display unit, may be implemented as hardware modules or firmware modules. An exemplary base station for alerting the user of the vehicle's arrival is explained in FIG. 3.

Figure 3:
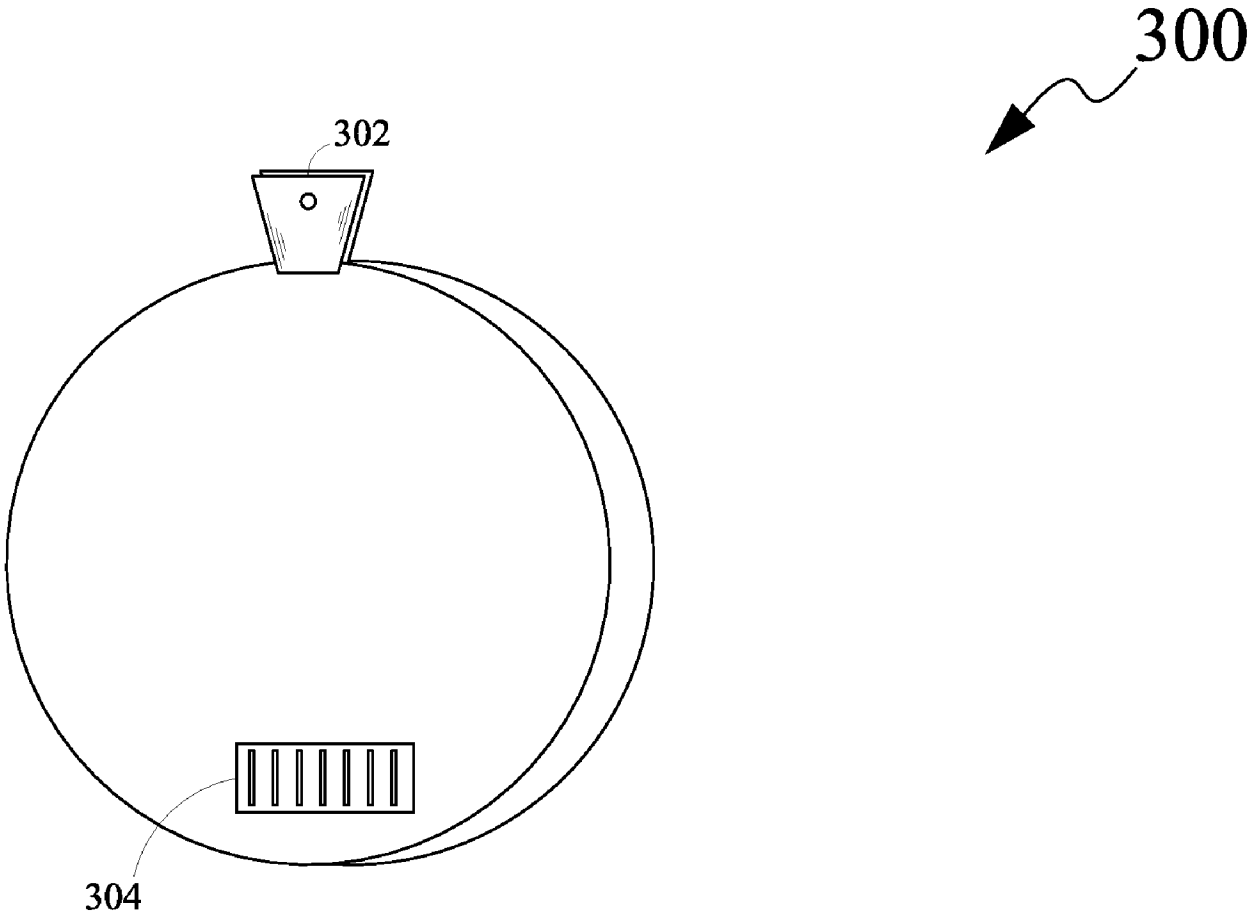
FIG. 3 illustrates a perspective view of the base station of FIG. 2, in accordance with an embodiment of the present invention.

Referring now to FIG. 3, a perspective view of a base station 300 is shown, in accordance with an exemplary embodiment of the present invention. The base station 300 includes a light source 302 and a speaker 304. The light source 302 is configured to generate a visual alert signal. Further, the speaker 304 is configured to generate an audio alert signal. The light source 302 may be similar in functionality to the light source explained in conjunction with the explanation of FIG. 2. Further, the speaker 304 may be similar to the speaker explained in conjunction with the explanation of FIG. 2. The light source 302 and the speaker 304 together form an exemplary sensory alert unit, such as the sensory alert unit 204 described in FIG. 2.

In an embodiment of the present invention, the base station 300 may include a motor (not shown) for generating a vibration alert signal.

In another embodiment of the present invention, the base station 300 may be capable of being mounted on a wall at the user location. The base station 300 may be mounted at an appropriate position on the wall, based on visual and audio range capabilities of the base station 300. In another embodiment of the present invention, the base station 300 may be portable. The base station 300 may be placed anywhere within the user location. Alternatively, the base station 300 may be capable of being worn by the user. For example, the base station 300 may be worn by the user on his/her wrist.

In another embodiment of the present invention, the base station 300 may be configured in one of a loud mode and a silent mode. In the loud mode at least the audio alert signal may be generated by the sensory alert unit of the base station 300 to alert the user of the vehicle's arrival. Alternatively, in the silent mode, the vibration alert signal may be generated by the sensory alert unit 204. In an embodiment of the present invention, a combination of the vibration alert signal and the visual alert signal may be generated by the sensory alert unit 204 in the silent mode.

It will be obvious to a person skilled in the art that components of the base station 300, such as the light source 302, the speaker 304 and the motor may be implemented as hardware modules or firmware modules. A method for alerting a user of the arrival of the vehicle at the user location is explained in conjunction with FIG. 4.

Figure 4:
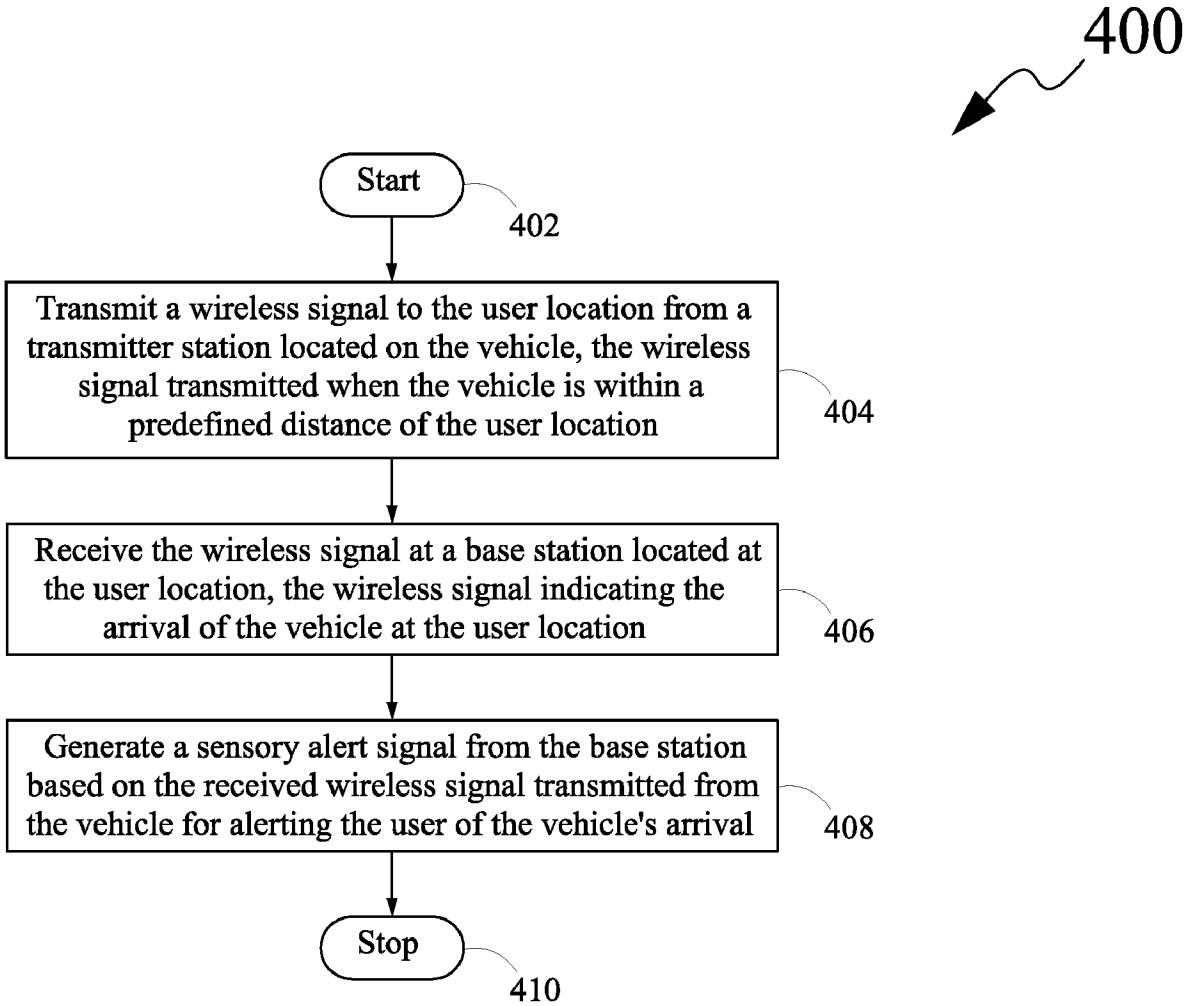
FIG. 4 illustrates a flow chart of a method for alerting a user of a vehicle's arrival at a user location, in accordance with an embodiment of the present invention.

FIG. 4 illustrates a flow chart representing a method 400 for alerting a user of a vehicle's arrival at a user location, in accordance with an embodiment of the present invention. Examples of the vehicle may be a bus, a train, a tram, a ferry boat, and the like. Examples of the user location may include residence of the user, waiting room of a train station, waiting room of a bus depot, and the like. As explained previously, it will be apparent to a person skilled in the art that the user location may be a pick-up point at which the vehicle is scheduled to arrive to pick the user. Alternatively, the pick-up point may be in a vicinity of the user location. However, for the purpose of this description, the user location is considered to be the pick-up point.

As illustrated in FIG. 4, the method 400 initiates at 402. At 404, a wireless signal is transmitted to the user location from a transmitter station, such as the transmitter station 100 of FIG. 1, located on the vehicle. The wireless signal may be transmitted when the vehicle is at least within a predefined distance range from the user. More specifically, the vehicle may be within the predefined distance range from a base station, such as the base station 200 or the base station 300, located at a user location. In an embodiment of the present invention, the predefined distance range may be a maximum transmission range of the transmitter station.

In another embodiment of the present invention, the predefined distance range may be a distance at which the transmitter station is in a line-of-sight with the base station. The predefined distance range may be determined based on time that the vehicle takes to reach the user location from a point at which the wireless signal is transmitted. In an embodiment of the present invention, an input may be received at the transmitter station by a person traveling in the vehicle, such as a passenger, a driver, a vehicle conductor, and the like, for transmitting the wireless signal to the user at the base station. The input may be received at the transmitter station when a transmitter button, such as the transmitter button 102, is pressed by the person in the vehicle.

In an embodiment of the present invention, the wireless signal transmitted to the user at the user location may include information, such as distance of the vehicle from the user location, estimated time to reach the user location, and the like. The information may be embedded in the wireless signal prior to transmitting the wireless signal.

At 406, the wireless signal is received at the base station located at the user location. The reception of the wireless signal indicates an impending arrival of the vehicle at the user location. In an embodiment of the present invention, the wireless signal may be received by a receiving antenna, as explained in conjunction with FIG. 3. In an embodiment of the present invention, the wireless signal received at the base station may be decoded to retrieve the information.

At 408, a sensory alert signal is generated at the base station based on the received wireless signal for alerting the user of the vehicle's impending arrival at the user location. The sensory alert signal includes at least one of a visual alert signal, an audio alert signal and a vibration alert signal. An example of the visual alert signal may include a flashing light. An example of the audio alert signal may include a sound similar to horn of the vehicle. The method 400 ends at 410. Another method for alerting a user of the vehicle's arrival is explained in FIG. 5.

Figure 5:
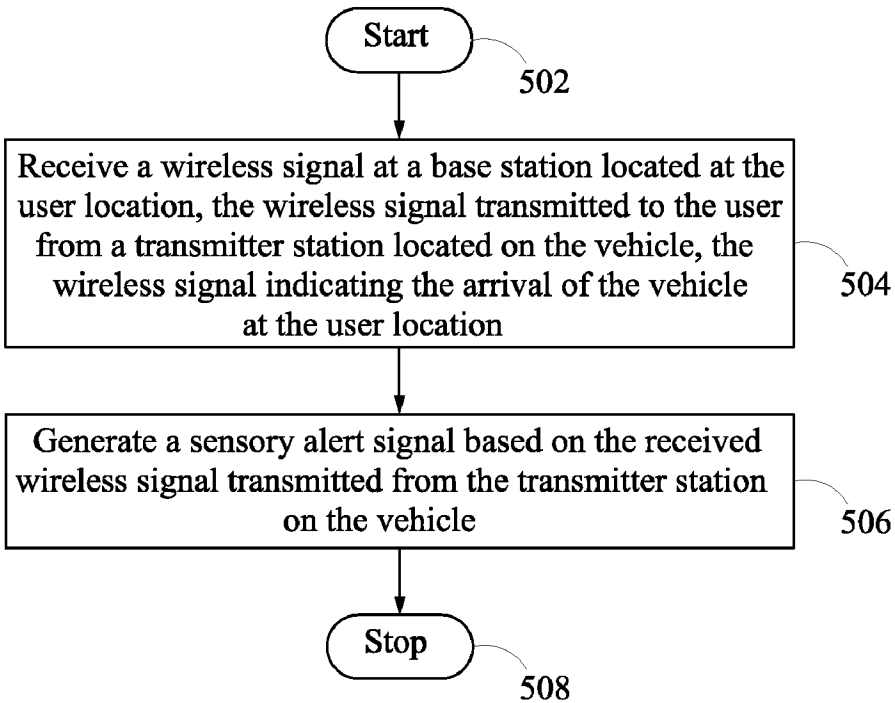
FIG. 5 illustrates a flow chart of a method for alerting a user of a vehicle's arrival at a user location, in accordance with another embodiment of the present invention.

FIG. 5 illustrates a flow chart representing a method 500 for alerting a user of a vehicle's arrival at a user location, in accordance with another embodiment of the present invention. The method 500 initiates at 502. At 504, a wireless signal is received at a base station, such as the base station 200 or the base station 300, located at the user location. The wireless signal is transmitted to the user from a transmitter station, such as the transmitter station 100, located on the vehicle. The wireless signal indicates an impending arrival of the vehicle at the user location.

At 506, a sensory alert signal is generated at the user location based on the received wireless signal. The sensory alert signal may include at least one of a visual alert signal, an audio alert signal and a vibration alert signal. It will be evident to a person skilled in the art that the sensory alert signal may be generated as explained in conjunction with FIGS. 2, 3 and 4. At 508, the method 500 ends.

In an embodiment of the present invention, the wireless signal transmitted to the user at the user location may include information, such as distance of the vehicle from the user location, estimated time to reach the user location, and the like. The information may be embedded within the wireless signal based on the input received from a person, such as a passenger, a driver or a conductor, in the vehicle. The wireless signal may be received by a receiving antenna such as the receiving antenna disclosed in conjunction with the explanation of FIG. 2 and FIG. 3. Further, the received wireless signal may be decoded at the base station. Further, the decoded information may be displayed to the user at the user location. The decoded information may also be provided to the user in an audio format.

The wireless signal received by the base station may be transmitted from a transmitter station when the vehicle is at least within a predefined distance from the user location. In an embodiment of the present invention, the predefined distance range may be a distance at which the transmitter station is in a line-of-sight with the base station. The predefined distance range may be determined based on time that a vehicle takes to reach a user location from a point at which the wireless signal is transmitted.

Alerting a user of arrival of a vehicle as implemented by system, such as the transmitter station 100, the base station 200 and the base station 300, and method, such as the method 400 and the method 500, is advantageous for reducing time for which the user has to wait for the vehicle to arrive at a user location. Further, time spent by passengers present in the vehicle, waiting for the user to board the vehicle, may also be reduced. Furthermore, low investment is required in infrastructure, thereby reducing cost. Moreover, the user may be alerted in a simple and user friendly manner. The user may be alerted by sensory alert signals that may be adjusted for disabled users. For example, a vibration alert may be used by visually impaired people. A visual alert signal may be used for deaf people. A base station of the present invention may be portable and may be worn on a user's body, thereby enabling the user to be alerted while in motion.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The embodiments were chosen and described in order to best explain the principles of the present invention and its practical application, and thereby enable others skilled in the art to best utilize the present invention and various embodiments with various modifications as are suited to the particular use contemplated. It is understood that various omissions and substitutions of equivalents are contemplated as circumstances may suggest or render expedient, but such are intended to cover the application or implementation without departing from the spirit or scope of the claims of the present invention.

What is claimed is:

1. A method for alerting a user of a vehicle's arrival at a user location, the method comprising:

transmitting a wireless signal to the user location from a transmitter station located on the vehicle, the wireless signal transmitted when the vehicle is at least within predefined distance range of the user location;

transmitting data within the wireless signal, where the data concerns parameters related to the transmitter station;

receiving the wireless signal at a base station located at the user location;

decoding data transmitted with the wireless signal via the base station; and generating a sensory alert signal at the base station based on the received wireless signal for alerting the user of the vehicle's arrival.

2. The method of claim 1, further comprising receiving an input at the transmitter station for transmitting the wireless signal to the user when the vehicle is within predefined distance range of the user location.

3. The method of claim 2, wherein the input is received when a transmitter button of the transmitter station is pressed.

4. The method of claim 1, wherein the sensory alert signal comprises at least one of a visual alert signal, an audio alert signal and a vibration alert signal.

5. A method for alerting a user of a vehicle's arrival at a user location, the method comprising:

receiving a wireless signal at a base station located at the user location, the wireless signal transmitted to the user from a transmitter station located on the vehicle;

decoding data sent with the wireless signal at the base station, where said data includes parameters concerning the transmitter station; and generating a sensory alert signal based on the received wireless signal transmitted for alerting the user of the arrival of the vehicle.

6. The method of claim 5, wherein the sensory alert signal comprises at least one of a visual art signal, an audio alert signal and a vibration alert signal.

7. The method of claim 5, wherein the wireless signal is transmitted from the transmitter station when the vehicle is within a predefined distance range of the user location.

8. A system for alerting a user of a vehicle's arrival at a user location, the system comprising:

a transmitter station located on the vehicle, the transmitter station configured to transmit a wireless signal to the user location, the wireless signal transmitted to the user when the vehicle is at least within a predefined distance range of the user location, where the wireless signal includes data related to the transmitter station parameters;

a base station located at the user location, the base station comprising:

a receiving unit configured to receive the wireless signal and decode data transmitted with the wireless signal; and a sensory alert unit configured to generate a sensory alert signal based on the received wireless signal.

9. The system of claim 8, wherein the base unit is capable of being mounted on a wall at the user location.

10. The system of claim 8, wherein the base unit is portable and is capable of being worn by the user.

11. The system of claim 8, wherein the sensory alert signal comprises at least one of a visual alert signal, an audio alert signal and a vibration alert signal.

12. The system of claim 11, wherein the sensory alert unit comprises at least one of a light source for generating the visual alert signal, a speaker for generating the audio alert signal and a means for generating the vibration alert signal.

13. The system of claim 8, wherein the transmitter station further comprising a transmitter button, the transmitter button is configured to receive an input at the transmitter station.

14. The system according to claim 8, wherein said data includes at least one of a distance between the transmitter station and the base station, and an estimated time of arrival for the vehicle.

* * * * *